US011750319B1

(12) United States Patent
Kong et al.

(10) Patent No.: US 11,750,319 B1
(45) Date of Patent: Sep. 5, 2023

(54) COVERT COMMUNICATION TECHNIQUE FOR INTELLIGENT REFLECTING SURFACE ASSISTED WIRELESS NETWORKS

(71) Applicant: U.S. Army DEVCOM, Army Research Laboratory, Adelphi, MD (US)

(72) Inventors: Justin S. Kong, Claksville, MD (US); Fikadu T. Dagefu, Columbia, MD (US); Jihun Choi, Silver Spring, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/748,921

(22) Filed: May 19, 2022

(51) Int. Cl.
*H04K 3/00* (2006.01)

(52) U.S. Cl.
CPC ..... *H04K 3/68* (2013.01); *H04K 3/80* (2013.01)

(58) Field of Classification Search
CPC ..... H04K 3/224; H04K 3/68
USPC ..... 455/1; 370/236; 342/13
See application file for complete search history.

(56) References Cited

U.S. PATENT DOCUMENTS 8,830,112 B1 * 9/2014 Buehler ..... H04K 3/68 342/13
10,818,991 B2 * 10/2020 Henry ..... G01R 27/32
10,826,644 B2 * 11/2020 Hunt ..... H04K 3/68
2015/0236811 A1 * 8/2015 Akita ..... H04K 1/08 455/1
2016/0381596 A1 * 12/2016 Hu ..... H04W 28/0268 370/236
2017/0126202 A1 * 5/2017 Shapoury ..... H01P 1/20381
(Continued)

FOREIGN PATENT DOCUMENTS

WO WO 2006/020864 * 2/2006 ..... G01S 13/00

OTHER PUBLICATIONS

C. Huang, A. Zappone, G. C. Alexandropoulos, M. Debbah, and C. Yuen, "Reconfigurable intelligent surfaces for energy efficiency in wireless communication," IEEE Trans. Wireless Commun., vol. 18, No. 8, pp. 4157-4170, Aug. 2019.
(Continued)

*Primary Examiner* — Tan H Trinh
(74) *Attorney, Agent, or Firm* — Eric B. Compton

(57) ABSTRACT

We disclose a novel methodology for wireless networks that optimizes the transmission probability, transmit power at an agent, and the reflection matrix of an IRS for covert RF communications. Key features include: (1) An exact closed-form expression for the expected detection error probability (DEP) at an adversary is provided considering the transmission probability at the agent; and (2) a novel method to optimize the transmission probability, transmit power at the agent and the reflection matrix of the IRS with the goal of maximizing the achievable rate at a client while ensuring a covertness constraint is developed. More specifically, the method may require only one-dimensional line search schemes, achieves near-optimal performance, and exhibits enhanced achievable data rate when compared to the conventional technique without the transmission probability optimization.

20 Claims, 8 Drawing Sheets

(56) References Cited

U.S. PATENT DOCUMENTS

2021/0356237 A1* 11/2021 Priest ..... B64C 39/024
2023/0021768 A1* 1/2023 Fayazbakhsh ..... H04B 7/026

OTHER PUBLICATIONS

M. D. Renzo et al., "Smart radio environments empowered by reconfigurable AI meta-surfaces: An idea whose time has come," Eurasip J. Wireless Commun. Netw., vol. 129, pp. 1-20, May 2019.
Q. Wu and R. Zhang, "Intelligent reflecting surface enhanced wireless network via joint active and passive beamforming," IEEE Trans. Wireless Commun., vol. 18, No. 11, pp. 5394-5409, Nov. 2019.
H. Guo, Y.-C. Liang, J. Chen, and E. G. Larsson, "Weighted sumrate maximization for reconfigurable intelligent surface aided wireless networks," IEEE Trans. Wireless Commun., vol. 19, No. 5, pp. 3064-3076, May 2020.
E. Björnson, Ö. Özdogan, and E. G. Larsson, "Intelligent reflecting surface versus decode-and-forward: How large surfaces are needed to beat relaying?," IEEE Wireless Commun. Lett., vol. 9, No. 2, pp. 244-248, Feb. 2020.
J. Lyu and R. Zhang, "Spatial throughput characterization for intelligent reflecting surface aided multiuser system," IEEE Wireless Commun.Lett., vol. 9, No. 6, pp. 834-838, Jun. 2020.
G. C. Alexandropoulos, K. Katsanos, M. Wen, and D. B. da Costa, "Safeguarding MIMO communications with reconfigurable metasurfaces and artificial noise," Nov. 2020. [Online] Available: https://arxiv.org/pdf/2005.10062.
S. Yan, X. Zhou, J. Hu, and S. V. Hanly, "Low probability of detection communication: Opportunities and challenges," IEEE Wireless Commun., vol. 26, No. 5, pp. 19-25, Oct. 2019.
B. He, S. Yan, X. Zhou, and V. K. N. Lau, "On covert communication with noise uncertainty," IEEE Commun. Lett., vol. 21, No. 4, pp. 941-944, Apr. 2017.
K. Shahzad, X. Zhou, S. Yan, J. Hu, F. Shu, and J. Li, "Achieving covert wireless communications using a full-duplex receiver," IEEE Trans Wireless Commun., vol. 17, No. 12, pp. 8517-8530, Dec. 2018.
Y. Zhao, Z. Li, N. Cheng,W.Wang, C. Li, and X. Shen, "Covert localization in wireless networks: Feasibility and performance analysis," IEEE Trans. Wireless Commun., vol. 19, No. 10, pp. 6549-6563, Oct. 2020.
H.-S. Im and S.-H. Lee, "Mobility-assisted covert communication over wireless ad hoc networks," IEEE Trans. Inf. Forensics Security, vol. 16, pp. 1768-1781, 2020.
X. Lu, E. Hossain, T. Shafique, S. Feng, H. Jiang, and D. Niyato, "Intelligent reflecting surface enabled covert communications in wireless networks," IEEE Netw., vol. 34, No. 5, pp. 148-155, Sep./Oct. 2020.
J. Si et al., "Covert transmission assisted by intelligent reflecting surface," Jan. 2021. [Online] Available: https://arxiv..org/pdf/2008.05031.
X. Zhou, S. Yan, Q. Wu, F. Shu, and D. W. K. Ng, "Intelligent reflecting surface (IRS)-aided covert wireless communication with delay constraint," Nov. 2020. [Online] Available: https://arxiv.org/pdf/2011.03726.
L. Lv, Q. Wu, Z. Li, Z. Ding, N. Al-Dhahir, and J. Chen, "Covert communication in intelligent reflecting surface-assisted NOMA systems:Design, analysis, and optimization," Dec. 2020. [Online] Available: https://arxiv.org/pdf/2012.03244.
G. C. Alexandropoulos and E. Vlachos, "A hardware architecture for reconfigurable intelligent surfaces with minimal active elements for explicit channel estimation," in Proc. IEEE Int. Conf. Acoust. Speech Signal Process. (ICASSP), May 2020, pp. 9175-9179.
Wankai Tang et al., "Wireless Communications With Reconfigurable Intelligent Surface: Path Loss Modeling and Experimental Measurement," IEEE Transactions on Wireless communications, 20(1), Jan. 2021, pp. 421-439.
Qingqing Wu and Rui Zhang "Towards Smart and Reconfigurable Environment: Intelligent Reflecting Surface Aided Wireless Network," IEEE Communications Magazine, 58(1), Jan. 2020, pp. 106-112.
Justin Kong, Fikadu T. Dagefu, Jihun Choi, and Predrag Spasojevic, "Intelligent Reflecting Surface Assisted Covert Communication With Transmission Probability Optimization," IEEE Wireless Communications Letters, 10(8), 2021, pp. 1825-1829 (Date of publication May 21, 2021).

* cited by examiner (*BACKGROUND*)

(*BACKGROUND*)

COVERT COMMUNICATION TECHNIQUE FOR INTELLIGENT REFLECTING SURFACE ASSISTED WIRELESS NETWORKS

GOVERNMENT INTEREST

The invention described herein may be manufactured, used and licensed by or for the U.S. Government without the payment of royalties thereon.

RELATED PUBLICATION

Some aspects relating to this invention have been previously disclosed by the inventors in the following paper: Justin Kong, Fikadu T. Dagefu, Jihun Choi, and Predrag Spasojevic, "Intelligent Reflecting Surface Assisted Covert Communication With Transmission Probability Optimization," IEEE Wireless Communications Letters, 10(8), 2021, pp. 1825-1829, herein incorporated by reference in its entirety for all purposes.

BACKGROUND OF THE INVENTION

Field

Embodiments of the present invention are directed to a covert communication technique for intelligent reflecting surface-assisted wireless networks.

Description of Related Art

Due to the increasing presence of adversaries and the threat they pose to both civilian and military networks, it is important to develop sophisticated secure wireless communication techniques.

For many wireless communications applications, it is important to establish a covert communication system that hides the existence of the communication between a transmitter (agent) and a receiver (receiver). Some conventional methods for covert communications considered optimizing the achievable rate at a client by adjusting the transmission probability at an agent. This type of optimization has shown limited success.

Recently, intelligent reflecting surface (IRS)-based transmission, which adaptively reconfigures wireless environments via software-controlled reflections, has gained a lot of attention as a promising technology to significantly improve the performance of wireless communication networks in an energy-efficient way as well as enhance covert communications. However, conventional techniques for IRS-assisted covert communication assume that the transmission probability at an agent is fixed to 0.5, i.e., equal a priori probability. Even though covert performance can theoretically be improved by optimizing the transmission probability, a strategy with the transmission probability optimization for IRS-supported covert communication networks has not been developed.

In light of the foregoing, improvements in covert communications for intelligent reflecting surface-assisted wireless networks are desired.

BRIEF SUMMARY OF THE INVENTION

We disclose a novel methodology that enables covert communications for devices in intelligent reflecting surface (IRS)-assisted wireless networks. It optimizes the transmission probability and transmit power at an agent, and the reflection matrix of an IRS. As will be further disclosed, the methodology enables the optimization, and preferably, the maximization of the achievable data rate at a client while ensuring the covertness of the transmission. It satisfies a constraint on the covertness of the transmission while maximizing the achievable data communication rate to a client receiving the transmission.

In this regard, we provide a novel strategy that jointly optimizes the transmission probability, transmit power at an agent, and the reflection matrix of an IRS with the goal of maximizing the achievable rate at a client while ensuring the covertness of the transmission. More specifically, the expected detection error probability (DEP) at a potential adversary is analyzed. Then, a technique for the covert achievable rate maximization is developed based on the analyzed expected DEP. The methodology may be implemented using only one-dimensional line search methods. And, it can use statistics of the channel to the adversary instead of the information about the instantaneous channel to the adversary.

We have found that a joint optimization of transmission probability, transmit power, and the IRS reflection matrix, enhances the achievable data rate at a client, ensure the covertness of the transmission, only requires one-dimensional line search methods (i.e., low computational complexity), only require the statistic of the channel to an adversary, and does not require any instantaneous information about the channel to adversary. The agent and IRS may preferably find their transmission strategy by using the statistic of the channel to the adversary.

Our methodologies can be applied to wireless RF networks communications which incorporate an IRS that reflects RF signals from an agent to increase the coverage region and maximize the achievable data rate at a client (e.g., command post, soldier, first responder or another agent). In addition, the transmission techniques as used in relevant networks should provide security to prevent malicious eavesdroppers from detecting the existence of the communication in the battlefield. They provide an IRS-assisted communication method that establishes a covert communication link between an agent and a client with low computational complexity and with only the statistic of the channel to an adversary.

According to embodiments, we provide a method for covert wireless RF communications between an agent device and a client device in the presence of an adversary device which attempts to detect the existence of the transmission of the RF communication between the agent and client. The method comprises: providing an intelligent reflecting surface (IRS) to reflect wireless radio frequency (RF) communication signals transmitted from the agent device to the client device, the IRS comprising a two-dimensional array of individually-controllable RF reflecting elements; and establishing a covert RF communication link between the agent device and the client device. This can be judiciously achieved by determining a transmission probability $\lambda$ between the agent device and the client device, a transmit power P at an agent and an IRS reflection matrix $\Theta$ for configuration data for the IRS elements to optimize an achievable data rate at a client $\overline{R}_C$ while ensuring covertness of the transmission. It may be a joint optimization.

The particulars of the methodology are discussed below. Briefly we summarize some: For ensuring covertness of the transmission, we mean an expected DEP would be larger than a target DEP $\epsilon$. And, for establishing the covert communication link between the agent device and the client device by said determining may comprise the steps of: a) determining the transmission probability $\lambda$ between the agent device and the client device that optimizes the achievable data rate at the client device $\overline{R}_C$ taking into account an expected detection error probability (DEP) at an adversary device; b) determining the transmit power P of the agent that satisfies covertness of the transmission for the RF communication for the determined transmission probability λ; and c) determining the IRS reflection matrix Θ.

For the determination in step a), we can seek to maximize an upper bound of the achievable data rate at the client device $\overline{R}_C$. We preferably compute the DEP using a statistic of the channel to the adversary device. For instance, the DEP may be computed according to eq. (6) below. More, we can define a covertness constraint and can compute it from the expected DEP according to eq. (7) below. The achievable data rate at the client device $\overline{R}_C$ may be computed according to eq. (8) below. For the determination in step c), we can compute the IRS reflection matrix Θ according to eq. (10) below. The IRS reflection matrix can be computed in every communication slot. The determination in step a) can be performed using an extremum-finding algorithm, such as a golden section search scheme. And the determination in step b) is performed using a root-finding algorithm, such as a bisection method.

The method may further include a step of configuring the IRS for RF communication between the agent device and the client device based on the determined IRS reflection matrix. In some embodiments and implementations, the agent performs methodology. And it can wirelessly transmit the determined IRS reflection matrix to the IRS.

In further embodiments, we further provide a wireless network implementing the aforementioned methodologies. The network may comprise: an intelligent reflecting surface (IRS) comprising a 2D array individually-controllable RF reflecting elements to reflect a wireless radio frequency (RF) signals transmitted from an agent device to an client device; and a controller configured to establish a covert RF communication link between the agent device and the client device by: determining a transmission probability λ between the agent device and the client device, a transmit power P at an agent and an IRS reflection matrix Θ for configuration data for the IRS elements to optimize an achievable data rate at a client $\overline{R}_C$ while ensuring covertness of the transmission. In some implementations, the IRS comprises at least 20 RF reflecting elements. For example, there could be 50, 100, 1000 or even possible more RF reflecting elements forming the IRS. Each of the individually controllable RF reflecting elements is configured to provide a phase shift to the reflected signal.

These and other embodiments of the invention are described in more detail, below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments, including less effective but also less expensive embodiments which for some applications may be preferred when funds are limited. These embodiments are intended to be included within the following description and protected by the accompanying claims.

DETAILED DESCRIPTION

We believe there are three key challenges in designing IRS-assisted covert communication techniques with the transmission probability optimization. They are as follows: (1) identifying an analytical expression of the detection error probability at an adversary with an arbitrary transmission probability at an agent, (2) computing the transmission probability and transmit power at the agent which are correlated, and (3) obtaining the transmission probability and transmit power at the agent without having the exact expression of the achievable data rate at a client. Moreover, in order to mitigate the computational overhead, it is desirable to reduce the computational complexity of identifying the transmission strategy with only negligible performance loss.

Considering these challenges, we propose a novel methodology that sends a confidential message to the client with the aid of an IRS. In order to reduce the probability that the friendly communication signal is detected by an adversary, both the transmission probability and the transmit power at the agent in addition to the reflection matrix of the IRS are adjusted and optimized. Our methodology provides near-optimal performance and has low computational complexity since it uses only one-dimensional line search methods.

We disclose the joint optimization of the transmission probability, transmit power, and reflection matrix of an IRS for the scenario where the instantaneous channels to the adversary are unknown at the agent and the IRS. Herein, we identify an exact closed-form expression for the expected detection error probability (DEP) at the adversary considering the worst-case scenario from covertness perspective, i.e., the adversary can find the optimal detection threshold that minimizes the DEP. We demonstrate that the achievable data rate at the client is a unimodal function of the transmission probability when a constraint on the covertness should be fulfilled, i.e., the expected DEP must be higher than a target DEP. Based on the derived analytical results, we have developed a novel methodology that jointly optimizes the transmission probability, transmit power, and IRS reflection matrix with the aim of maximizing the achievable rate at the client while satisfying the covertness constraint. We do so, preferably, by utilizing only one-dimensional search schemes.

Figure 1:
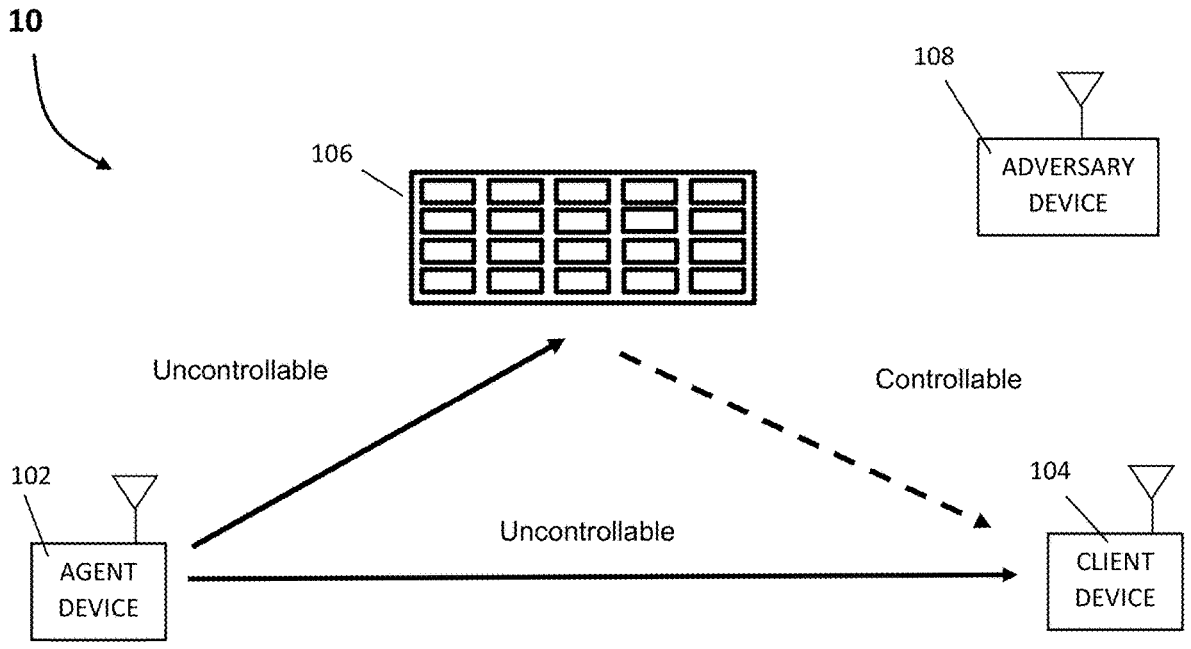
FIG. 1 is a schematic illustration depicting an exemplary wireless communications network in accordance with embodiments of the present invention.

FIG. 1 is a schematic illustration depicting an exemplary wireless communications network 10 in accordance with embodiments of the present invention. The wireless network 10 is formed of an agent device 102, a client device 104, and an intelligent reflecting surface (IRS) 106. The client may be an individual (e.g., a soldier, warfighter, commercial user) equipped with or otherwise using a radio. While one client is depicted, there could be others. Although, our methodology 400 (FIG. 4) is specifically designed to RF transmission from one agent to one client.

A potential adversary 108 may be located in a position to intercept or eavesdrop on RF communications between an agent 102 and the client 104. Potential adversaries 108 often utilize passive receiving devices and conceal their presence. They could be individuals with suitable RF devices or passive RF detectors sensors (also known as RF "sniffers" or "bugs"). Thus, their presence may not be known or otherwise detected by the agent 102 or client 104.

Figure 5:
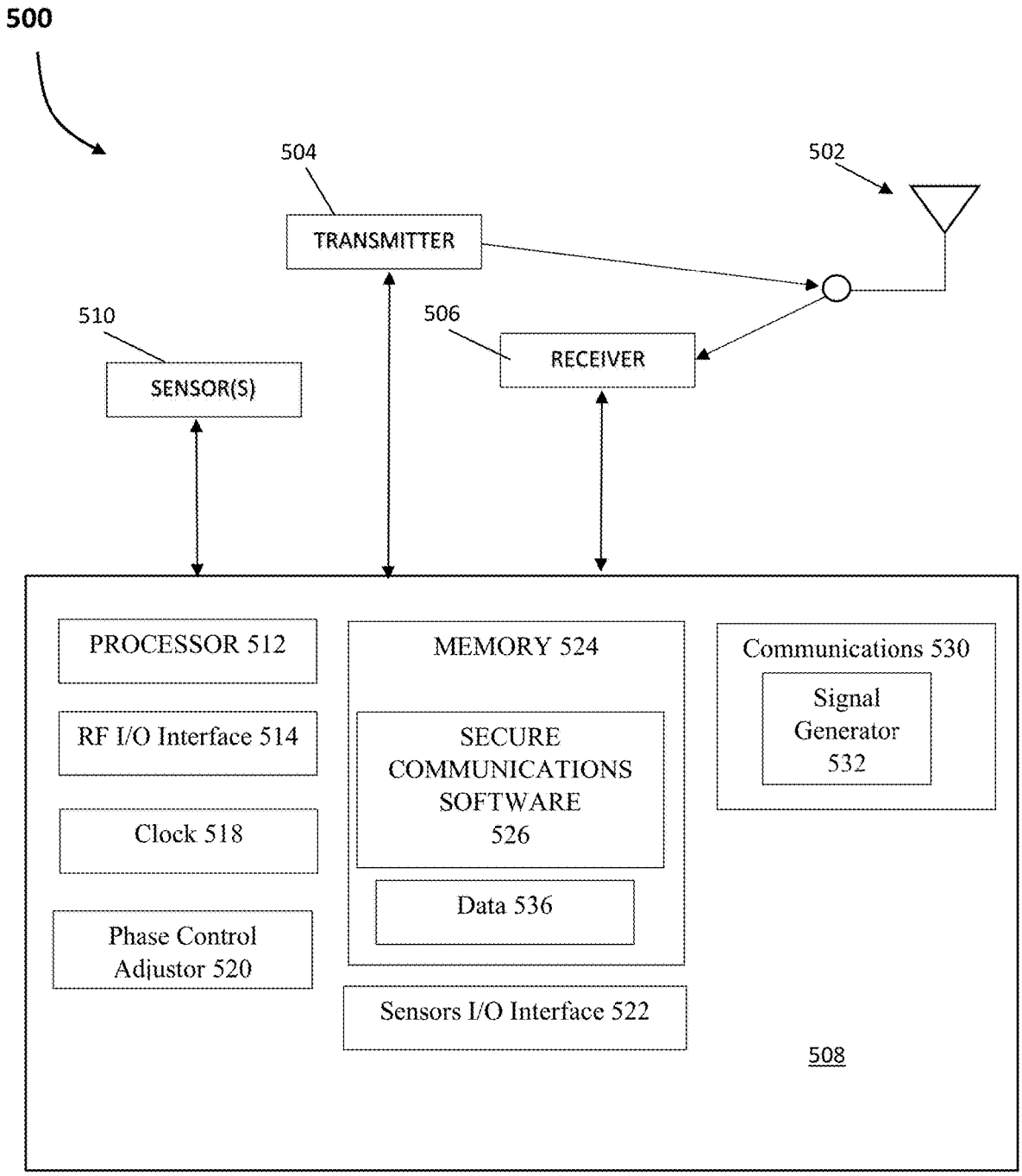
FIG. 5 depicts a simplified high-level block diagram of an exemplary transceiver for an agent device in accordance with an embodiment.

The agent device 102 and client device 104 are equipped with at least one antenna and other hardware for receiving/transmitting RF communications. FIG. 5 shows further details of the agent device 102 and the client device 104. The adversary device 108 is assumed to have an antenna and processing means for RF communications, but the particulars are generally unknown to those in the network 10.

The agent device 102 and the client device 104 are geometrically separated from one another in two-dimensional (2D) space, as shown, or it could be three-dimensional (3D) space. The agent communicates with the client. Our methodology presumes that the agent device 102 transmits a RF communication which the client device 104 receives. We call this an uncontrolled signal. In addition, the agent device 102 transmits a RF communication to the IRS 106 reflects and augments that RF communication which the client device 104 also receives. The former is uncontrolled while the latter is controlled by the IRS 106.

The role of the agent and client devices may continually reverse, in that, the client becomes an agent and transmits communications, and the agent becomes a client and receives the communication. The methodology described herein may repeat for the new agent and new client again and again as needed. This allows for truly two-wave and/or duplex communications among the devices.

In embodiments, the agent device 102 and client device 104 may be an autonomous vehicle, a mobile command station or an individual carrying a transceiver. The agent device 102 and client device 104 may be fixed or mounted on a ground-based, air-borne sea-borne, or space-based platform. The agent device 102 and client device 104 may be equipped with cameras and microphones for providing image/video data and sound/voice data. Additionally, they may be equipped with various sensor(s) for providing other information. Some non-limiting examples of sensors may include: additional or multispectral imaging (UV/visible/IR); antennas (RF; radio); ranging (radar; LIDAR); location/position sensors (GPS, altitude/depth, etc.), motion sensors (speed/velocity, bearing/trajectory, acceleration, etc.); weather sensors (temperature, pressure, wind speed, ambient lighting, etc.); and field sensors (electric, magnetic, vibrations, radiation, biological, etc.). Of course, other sensors and sensor information may also be provided for as may be desirable.

We illustrate the various RF signal channels involved: $h_I$, $h_A$, $h_C$, $g_A$ and $g_C$. They include direct and reflected transmissions channels. More particularly, the direct ones include: (i) the transmission channel from the agent device to the client device, $h_C$; (ii) the transmission channel from the agent device to the adversary device, $h_A$; and (iii) the transmission channel from the agent device to the IRS, $h_I$. And the reflected ones include: (iv) the transmission channel from IRS to the client device, $g_C$; and (v) the transmission channel from the IRS to the adversary device, $g_A$. Note: we use solid lines to represent direct transmission and the dotted-lines to represent reflections from the IRS. The reflected signals ($g_A$ and $g_C$) are augmented by the IRS 106 as later explained with respect to FIGS. 2A and 2B.

In actuality, the agent device transmits one RF signal which radiates in multiple directions. Of particular interest, are signal in the directions to the client device, the IRS, and the adversary device. We refer to them as channels: $h_I$, $h_A$, and $h_C$, respectively. There is one channel impinging on the IRS ($h_I$). The IRS 106 reflects and augments the signal from the agent device 102, as discussed herein. It too radiates in multiple directions. Of particular interest are the augmented reflected signal in the directions to the client device and the adversary device. We refer to them as channels: $g_A$ and $g_C$, respectively.

Key goals of our novel methodology are for (1) the transmission from agent device to the client device $h_C$ and the reflected augmented signal from the IRS to the client device $g_C$ to coherently combine; and (2) for the transmission from client device to the adversary device $h_A$ and the reflected augmented signal from the IRS to the adversary device $g_A$ to cause confusion via destructive interference.

Intelligent reflecting surfaces (IRS) for wireless RF communications are generally known and discussed in the open literature. See, for example, Wankai Tang et al., "Wireless Communications With Reconfigurable Intelligent Surface: Path Loss Modeling and Experimental Measurement," IEEE Transactions on Wireless communications, 20(1), January 2021, pp. 421-439; and Qingqing Wu and Rui Zhang "Towards Smart and Reconfigurable Environment: Intelligent Reflecting Surface Aided Wireless Network," IEEE Communications Magazine, 58(1), January 2020, pp. 106-112, herein incorporated by reference in their entirety.

Figure 2A:
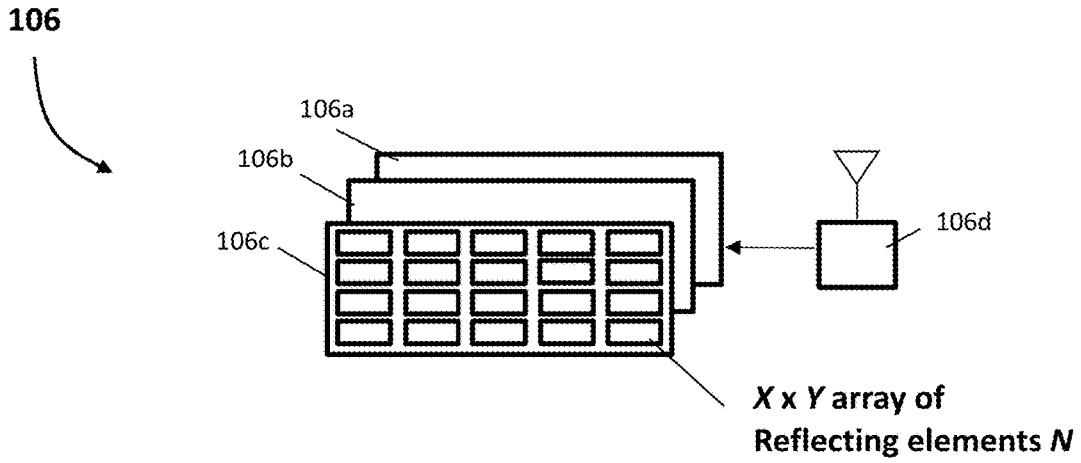
FIGS. 2A and 2B show the architecture of a conventional intelligent reflecting surface.
Figure 2B:
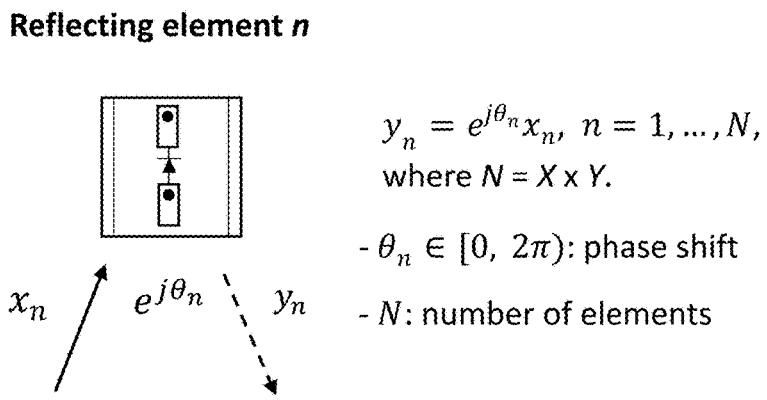

FIGS. 2A and 2B show the architecture of a conventional IRS adapted from the Wu et al. (2021) paper. We can use the same IRS components for the IRS 106 in various embodiments of the present invention. Thus, we will not only briefly describe here as one can turn to the aforementioned references for further details. As shown in FIG. 2A, the IRS 106 is generally composed of a printed circuit board 106*a*, conductive metal backplane 106*b*, and an outer reflecting surface 106*c* having plurality of reflecting elements which are controlled by an IRS controller 106*d*. The reflecting elements of the surface 106*c* are arranged in a 2D array represented by the number of rows and columns of elements, X and Y, respectively. Thus, the number of reflecting elements N of IRS 106 is simply equal to X×Y. In Table II of the Tang paper, they considered different number of rows and columns of elements for their IRS. For adequate control of the communications using the IRS, we believe there should be at least 20 RF reflecting elements. We considered our numerical simulations for an IRS with 50 RF reflecting elements. The number of reflecting elements may be 100 or more in other embodiments. Even larger numbers of reflecting elements, for instance, up to and exceeding 1000, may be used in still further embodiments.

According to our embodiment, the IRS 106 may be fixed (static) or could be movable. The novel methodology assumes that channels are known; so, when the channels vary, we have to update solutions using the changed channels either way. For static IRSs, they may be mounted on a building, cell phone tower or other tall structure. And, for moving IRSs, they may be mounted on various platforms, including, for instance, space-based (e.g., satellites, rocket ships, space stations, etc.), air-based vehicles (e.g., aircraft, helicopter, blimp, UAV, etc.), ground-based (e.g., cars, trucks, military vehicles, and mobile command center, etc.), and sea-based (ships, submarines, etc.) as some non-limiting examples.

FIG. 2B illustrates an example of an individual reflecting element's structure for the IRS 106. It is composed of a PIN diode is embedded in each reflecting element n. By judiciously controlling the biasing DC voltage, the PIN diode can be switched "On" and "Off" thereby generating a phase-shift difference. Although, we note other types and designs of IRS may certainly be used.

Each reflecting element can be individually controlled with its own biasing voltage signal from the IRS controller. The reflecting element receives an incoming RF signal $x_n$ and outputs a reflected augments signal $y_n=e^{j\theta_n}x_n$, n=1, . . . , N, where N=X×Y, and $\theta_n$ is the phase shift. The phase shift may range from 0 to $\pm 2\pi$ radians.

To control the reflection amplitude, a variable resistor load can be applied in the element design. By changing the values of resistors in each of the reelecting elements, different portions of the incident signal's energy are dissipated, thus achieving controllable reflection amplitude between 0 and 1 (0 to 100%). The amplitude and phase shift at each element of the IRS may be independently controllable. In our methodology, we only focus on phase shift though.

Figure 3:
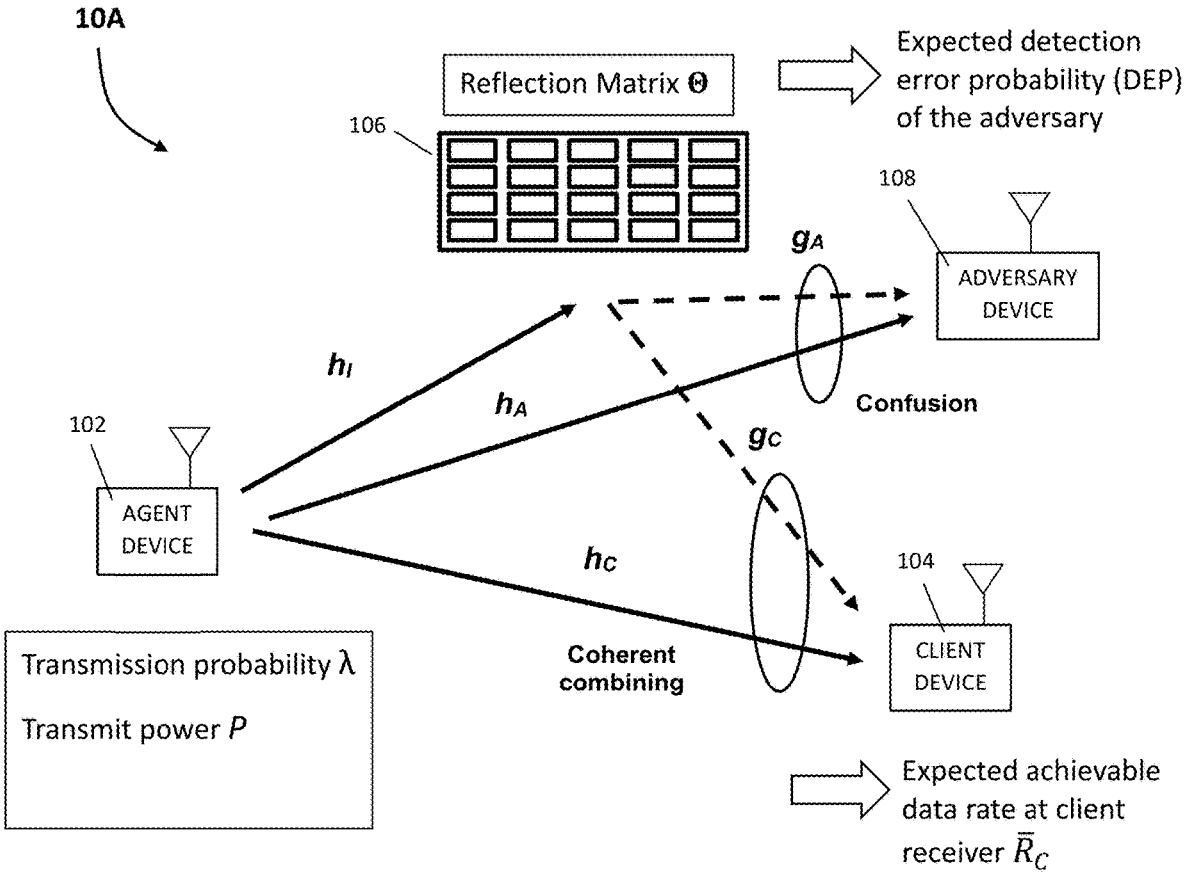
FIG. 3 is a schematic illustration of a network scenario and depict key variables involved in the novel methodologies used in embodiments of the present invention.

We illustrate in FIG. 3 a network scenario 10A and depict the key variables involved in the novel methodologies used in embodiments of the present invention. They include: (a) a transmission probability $\lambda$ between the agent device and the client device; (b) a transmit power P at an agent; (c) an expected achievable data rate at client receiver $\overline{R}_C$; (d) an expected detection error probability (DEP) of the adversary device, and (e) an IRS reflection matrix $\Theta$. We will briefly discuss each of these variables.

The transmission probability $\lambda$ between the agent device and the client device represents the statistical likelihood, under the circumstances, that a RF transmission sent from the agent device is received by the client device. The value is unitless and varies from 0 to 1 (0 to 100%). We intentionally vary $\lambda$ to achieve the aforementioned goals.

The transmit power P at the agent device is the transmission power of the agent device. It is controlled by the trans-receiver of the agent device. It may be given in terms of power, such as in units of Watt(s) or decibels per milliwatt (dBm). We optimize P to achieve the aforementioned goals. The maximum transmission power $P_{max}$ is an inherent property of the transmitted of the agent and is an upper bound of the optimized transmit power.

The expected achievable data rate at client device $\overline{R}_C$ represents the statistical data rate which under the circumstances would be expected at the client device receiver. We also refer to it herein as the covert data rate. It is a function of the transmission probability $\lambda$ between the agent device and the client device, and the powers of the both the signal directly transmitted by the agent device to the client and the signal from the client that is reflected and augmented by the IRS. This value may be given as a bandwidth, such as in units of bits-per-second (bps) per Hz or bps/Hz. We seek to optimize $\overline{R}_C$.

The expected detection error probability (DEP) of the adversary device represents the statistical likelihood that the adversary makes a wrong decision based upon a received RF transmission. This may mean that the received RF transmission is unrecognized or treated as nil by the adversary. The value is unitless and varies from 0 to 1 (0 to 100%). We specifically take into account the DEP in our methodology. As later explained, DEP is based on the transmission probability $\lambda$ between the agent device and the client device. We presume that that the adversary knows $\lambda$. This means that the maximum achievable DEP is min($\lambda$, 1−$\lambda$). Our goal is to achieve a target DEP which we refer to as $\epsilon$. If we want to achieve DEP $\epsilon$, $\lambda$ should be in [$\epsilon$, 1−$\epsilon$]. For example, if the adversary knows that $\lambda$=0.6, he can achieve DEP 0.4 by always deciding that there is a transmission.

The best scenario for us (and the worst for the adversary) is the case with 0.5 DEP since this means that the adversary has just a 50/50 probability of having any meaningful information from the received RF transmission. Thus, if we want a more secured network, we can assume high $\epsilon$ which is close to 0.5.

The reflection matrix $\Theta$ represents configuration information for the intelligent reflecting surface's elements. It may be a 2-D array of data that includes the phase augmentation information for the RF reflecting elements of the IRS. The IRS reflects N incoming signals. The received signal via IRS at the client is defined as $$\sum_{n=1}^{N} g_{C,n} e^{j\theta_n} h_{I,n}.$$

We used matrix $\Theta$ just to simply express $$\sum_{n=1}^{N} g_{C,n} e^{j\theta_n} h_{I,n}$$

as $g_C^T \Theta h_I$. The IRS's controller adjust the N elements based on the matrix data $\Theta$. These values may be reported as $\theta_n$, for instance, as phase shifts for the n-th incoming signal; the values will range from 0 to $2\pi$ radians (0 to 360°).

The following detailed description of the invention uses various notations and equations to describe the operation of the invention. Table 1 below lists a definition for each of the notations used below.

TABLE 1

LIST OF NOTATIONS

| Notation | Definition |
|---|---|
| L | Number of channels used in a slot |
| i | Channel index in a slot |
| $\Theta$ | IRS reflection matrix |
| $\theta_n$ | Phase shift for the n-th reflecting element of the IRS |
| X | Number of rows of reflecting elements of the IRS |
| Y | Number of columns of reflecting elements of the IRS |
| N | Number of reflecting elements of the IRS |
| $\lambda$ | Transmission probability |
| $\lambda_1$ | $\lambda$ achieving optimal $\overline{P}_E$ |
| $\lambda_2$ | $\lambda$ achieving optimal P |
| P | Transmit Power |
| $P_{max}$ | Maximum Transmit Power |
| $h_C$ | Channel between the agent and client |
| $h_A$ | Channel between the agent and adversary |
| $h_I$ | Channel between the agent and the IRS |
| $g_C$ | Channel between the IRS and the client |
| $g_A$ | Channel between the IRS and the adversary |
| $\chi_{h_C}$, $\chi_{h_A}$, $\chi_{h_I}$, $\chi_{g_C}$, and $\chi_{g_A}$ | Large-scale path losses of the corresponding channels |
| x | The transmit data signal at the agent |
| $y_C$ | The received data signal at the client |

TABLE 1-continued

| LIST OF NOTATIONS | |
|---|---|
| Notation | Definition |
| $y_A$ | The received data signal at the adversary |
| $n_C$ | Noise at the client |
| $n_A$ | Noise at the adversary |
| $\rho$ | Degree the noise uncertainty of the adversary |
| $\hat{\sigma}_A^2$ | Nominal noise power at the adversary |
| $\sigma_A^2$ | Variance of noise at the adversary |
| DEP | Detection error probability |
| $P_E$ | DEP for a given slot |
| $\overline{P}_E$ | Expected DEP over many slots |
| $\epsilon$ | Target DEP |
| $\overline{R}_C$ | Expected achievable data rate at the client |
| $\gamma$ | Detection threshold at the adversary |
| G | Channel gain |

The quasi-static Rayleigh fading channels are considered. A communication slot is composed of a block of L channel uses, and all channels remain constant in a slot and can change independently to different channels for the next slot. In order to confuse the adversary, the agent chooses whether to transmit a signal or not in every slot. The wireless channels may or may not change over time. But, for our methodology, we assume that channels remain constant during one slot (L channel uses) and change to different channels in the next slot.

Each element of channel is complex scalar. For example, $h_I$ is an N×1 vector and each element is a complex scalar. Also, these complex scalars are determined by many factors including center frequency and distance. More specifically, for a given slot, the agent sends a signal with a transmission probability $\lambda$.

The diagonal reflection coefficient matrix of the IRS is defined as $\Theta=\mathrm{diag}\{e^{j\theta_1}, e^{j\theta_2}, \ldots, e^{j\theta_N}\}\in\mathbb{C}^{N\times N}$ where $\theta_n\in[0,2\pi)$ is the phase shift of the n-th IRS element. For a given slot, denoting x[i]~CN(0,1) as the signal transmitted from the agent in the i-th channel use, the received signals at the client and adversary are respectively expressed as:

$$y_C[i]=\sqrt{P}(h_C+g_C^T\Theta h_I)\times[i]+n_C[i], \tag{1a}$$

$$y_A[i]=\sqrt{P}(h_A+g_A^T\Theta h_I)\times[i]+n_A[i], \tag{1b}$$

where P indicates the transmit power at the agent, and $h_C\sim CN(0,\chi_{h_C})$ and $h_A\sim CN(0,\chi_{h_A})$ represent the channels from the agent to client and the agent to adversary, respectively. Also, $h_I\in\mathbb{C}^{N\times 1}\sim CN(0,\chi_{h_I n})$, $g_C\in\mathbb{C}^{N\times 1}\sim CN(0,\chi_C I_N)$ and $g_A\in\mathbb{C}^{N\times 1}\sim CN(0,\chi_{g_A} I_N)$ stand for the channels from the agent to the IRS, from the IRS to the client, and from the IRS to the adversary, respectively, where $I_N$ denotes N×N identity matrix. Here, $\chi_{h_C}$, $\chi_{h_A}$, $\chi_{h_I}$, $\chi_{g_C}$, and $\chi_{g_A}$ mean the large-scale path losses of the corresponding channels. In addition, $n_C[i]\sim CN(0,\sigma_C^2)$ and $n_A[i]\sim CN(0,\sigma_A^2)$ are the complex additive Gaussian noise at the client and adversary, respectively.

The noise uncertainty at the adversary due to calibration error, temperature and environmental noise variations is considered. The exact noise power $\sigma_A^2$ in dB scale is uniformly distributed on $[\hat{\sigma}_{A,dB}^2-\rho_{dB}, \hat{\sigma}_{A,dB}^2+\rho_{dB}]$ where $\hat{\sigma}_A^2=10^{\hat{\sigma}_{A,dB}/10}$ and $\rho=10^{\rho_{dB}/10}$ stand for the nominal noise power and the degree of the noise uncertainty, respectively. Then, the probability density function of $\sigma_A^2$ is written as:

$$f_{\sigma_A^2}(x)=\frac{1}{2\ln(\rho)x}\mathbb{I}_{\{\frac{1}{\rho}\hat{\sigma}_A^2\le x\le\rho\hat{\sigma}_A^2\}}, \tag{2}$$

where $\mathbb{I}_{\{\cdot\}}$ is the indicator function.

The adversary is presumed to have knowledge of the transmit power P, transmission probability $\lambda$, $\eta\triangleq|h_A+g_A^T\Theta h_I|^2$ and the statistic of noise uncertainty ($\rho$ and $\hat{\sigma}_A^2$). This case presents a worst-case scenario from covertness perspective. The agent and IRS know the channels to the client ($h_C$, $g_C$ and $h_I$), but do not know the instantaneous channels to the adversary ($h_A$ and $g_A$). Instead, we assume that we only know the statistic of the channels ($\chi_{h_A}$, $\chi_{g_A}$). Put another way, we assume that the agent only has knowledge of the noise statistic at the adversary ($\rho$ and $\hat{\sigma}_A^2$) and the statistic of $\eta$. We note that $\eta$ is related to the channel terms and the channels are complex scalars which are determined by many factors including center frequency and distances.

We can estimate these statistics based on the distances between nodes. For the distance between a transmitter and a receiver d, the channel gain is modeled by $\chi$ (d) (in dB)=$G_t+G_r-37.5-22\log_{10}(d)$ if line-of-sight (LOS) and $\chi$ (d) (in dB)=$G_t+G_r-35.1-36.7\log_{10}(d)$ if non-LOS (NLOS) where $G_t$ and $G_r$ are the transmitter and receiver antenna gains, respectively, following the technique discussed in E. Björnson, Ö. Özdogan, and E. G. Larsson, "Intelligent reflecting surface versus decode-and-forward: How large surfaces are needed to beat relaying?," *IEEE Wireless Commun. Lett.*, vol. 9, no. 2, pp. 244-248, February 2020, herein incorporated by reference in its entirety.

Also, we mention and discuss various other noise parameters herein. We assume that these parameters exist and we can use exemplary values in [−110, −80] dBm. Alternatively or additionally, we could estimate and/or measure specific noise parameter values.

In order to detect the existence of the transmission, the adversary attempts to distinguish the following two hypotheses:

$$H_0: y_A[i]=n_A[i], \tag{3a}$$

$$H_1: y_A[i]=\sqrt{P}(h_A+g_A^T\Theta h_I)x[i]+n_A[i], \tag{3b}$$

where $H_0$ designates the null hypothesis in which there is no transmission and $H_1$ signifies the alternative hypothesis in which there is a transmission. In each communication slot, based on the observations $y_A[1], \ldots, y_A[L]$, the adversary makes a binary decision whether the agent's transmission happened or not. The adversary may employ a radiometer for the binary decision and conducts a simple threshold test as follows:

$$y_A\triangleq\frac{1}{L}\sum_{i=1}^{L}|y_A[i]|^2\underset{\mathcal{D}_0}{\overset{\mathcal{D}_1}{\gtrless}}\gamma, \tag{4}$$

where $\gamma$ is the detection threshold, and $D_0$ and $D_1$ respectively denote the decisions in favor of $H_0$ and $H_1$.

Then, for a slot, the detection error probability (DEP) at the adversary $P_E$ is given by:

$$P_E=\lambda P_{MD}+(1-\lambda)P_{FA}, \tag{5}$$

where $P_{MD}=\Pr(D_0|H_1)$ and $P_{FA}=\Pr(D_1|H_0)$ are respectively the missed detection probability and the false alarm probability. In every slot, the adversary computed the optimal detection threshold $\gamma$ that minimizes the DEP $P_E$ and makes a binary decision following the threshold test.

Assuming large L (for instance, more than 100), $y_A$ can be approximated by $\sigma_A^2$ when $H_0$ and $P\eta+\sigma_A^2$ when $H_1$ by the Strong Law of Large Numbers. Then, the DEP at the adversary is computed as follows:

$$P_E = \frac{1}{2\ln(\rho)x}\left[\lambda\ln\left(\frac{\max(\gamma - P\eta, \sigma_A^2/\rho)}{\sigma_A^2/\rho}\right) + (1-\lambda)\ln\left(\frac{\rho\sigma_A^2}{\gamma}\right)\right], \tag{6}$$

and when the optimal detection threshold $\gamma$ that minimizes $P_E$ is applied, the expectation of DEP $\overline{P}_E \triangleq \mathbb{E}[P_E]$ becomes:

$$\overline{P}_E = \frac{\tau}{2\ln(\rho)}\int_0^{\frac{\hat{\sigma}_A^2(1-1/\rho)}{P}} \min(\lambda\Xi_2(x), (1-\lambda)\Xi_1(x))e^{-\tau x}dx, \tag{7}$$

where $\tau = \chi_{h_A} + N\chi_{h_I}\chi_{g_A}$, $$\Xi_1(x) = \ln\left(\frac{\rho\hat{\sigma}_A^2}{Px + \hat{\sigma}_A^2/\rho}\right) \text{ and } \Xi_2(x) = \ln\left(\frac{\rho\hat{\sigma}_A^2 - Px}{\hat{\sigma}_A^2/\rho}\right).$$

Since the probability that the agent transmits data to the client is $\lambda$, the expected achievable data rate at the client receiver, $\overline{R}_C$, is given by:

$$\overline{R}_C = \lambda\mathbb{E}\left[\log_2\left(1 + \frac{P|h_C + g_C^T\Theta h_I|^2}{\sigma_C^2}\right)\right], \tag{8}$$

where the expectation is taken over slots, i.e., fading channels. The goal of this invention is to maximize $\overline{R}_C$ while satisfying the covertness constraint on the DEP at the adversary, i.e., $\overline{P}_E$ should be larger than a target DEP $\epsilon$. We term the achieved $\overline{R}_C$ with the covertness constraint as covert data rate.

Then, the covert data rate maximization problem is formulated as:

$$\max_{\lambda,P,\Theta}\overline{R}_C \text{ s.t. } P \le P_{max} \text{ and } \overline{P}_E \ge \epsilon, \tag{9}$$

where $P_{max}$ is the maximum available transmit power at the agent. Here, $\epsilon \in [0, \min(\lambda, 1-\lambda))$ since the maximum achievable $\overline{P}_E$ is $[0, \min(\lambda, 1-\lambda))$ when $\lambda$ is known at the adversary.

In the novel methodology, we provide a new covert communication technique that jointly optimizes $\lambda$, P and $\Theta$ for the covert rate maximization problem. First, the covertness constraint is independent with the IRS reflection matrix $\Theta$ since $\overline{P}_E$ is not relevant to $\Theta$. This implies that for any given $\lambda$ and P, the optimal $\Theta$ always maximizes the received signal strength $|h_C + g_C^T\Theta h_I|^2$ at the client in every slot. Hence, the optimal $\Theta = \mathrm{diag}\{e^{j\theta_1}, e^{j\theta_2}, \ldots, e^{j\theta_N}\}$ is obtained as:

$$\theta_n = \arg(h_C) - \arg(g_{C,n}) - \arg(h_{I,n}), \forall n, \tag{10}$$

where $\arg(\alpha)$ is the angle of complex scalar $\alpha$, and $g_{C,n}$ and $h_{I,n}$ indicate the n-th elements of $g_C$ and $h_I$, respectively.

We need the statistic of the channels for the computation of the expected DEP, not for computation of $\Theta$. Therefore, $\Theta$ is computed only based on the channels to the client as in eq. (10). The IRS can individually adjust the N elements to augment the reflection. $\theta_n$ means the phase shift for the n-th incoming signal. The received signal via IRS at the client is $$\sum_{n=1}^{N} g_{C,n}e^{j\theta_n}h_{I,n}.$$

We used matrix $\Theta$ just to simply express $$\sum_{n=1}^{N} g_{C,n}e^{j\theta_n}h_{I,n} \text{ as } g_C^T\Theta h_I.$$

For a given slot, of course, the received signal at the adversary (especially the term $\eta \triangleq |h_A + g_A^T\Theta h_I|^2$) is related to the computed $\Theta$. However, the statistic of $\eta$ is not relevant to $\Theta$ since the channels to the adversary and client are independent. $\eta$ is related to the channel terms and the channels are complex scalars which are determined by many factors including center frequency and distances. Therefore, the expected DEP in eq. (7) is irrelevant to $\Theta$. The parameter $\gamma$ in eq. (4) refers to detection threshold at the adversary. The adversary makes a binary decision there. The adversary computes $\gamma$ in every slot with the goal of minimizing the DEP in the slot. We consider multiple cases for computing $\gamma$ below:

A. Case 1: $\lambda \ge 0.5$

When $$\gamma \ge P_A\eta + \frac{\hat{\sigma}_W^2}{\rho},$$

$\Upsilon$ is always positive. As the optimal threshold $\hat{\gamma}$ is within the range $$\left[\frac{1}{\rho}\hat{\sigma}_W^2, \rho\hat{\sigma}_W^2\right],$$

we get $$\hat{\gamma} = \min\left(P_A\eta + \frac{\hat{\sigma}_W^2}{\rho}, \rho\hat{\sigma}_W^2\right).$$

B. Case 2: $\lambda < 0.5$

When $$\gamma \ge P_A\eta + \frac{\hat{\sigma}_W^2}{\rho},$$

$\Upsilon \ge 0$ if and only if $\gamma \le \phi$ where $$\phi \triangleq \frac{1-\lambda}{1-2\lambda}P_A\eta.$$

Thus, $$\text{(i) } \frac{\partial P_E}{\partial \gamma} < 0$$

when $$\text{(ii) } \gamma < P_A\eta + \frac{\hat{\sigma}_W^2}{\rho},\ \frac{\partial p_E}{\partial \gamma} \geq 0$$

if $$\gamma \geq P_A\eta + \frac{\hat{\sigma}_W^2}{\rho}$$

and $\gamma \leq \phi$, and $$\text{(iii) } \frac{\partial p_E}{\partial \gamma} < 0$$

if $$\gamma \geq P_A\eta + \frac{\hat{\sigma}_W^z}{\rho}$$

and $\gamma > \phi$.

Case 2-1: $\lambda < 0.5$ and $$P_A\eta + \frac{\hat{\sigma}_W^2}{\rho} \leq \rho\hat{\sigma}_W^2$$

(1) If $$\phi \leq P_A\eta + \frac{\hat{\sigma}_W^2}{\rho},$$

since $$\frac{\partial P_E}{\partial \gamma}$$

is always negative for $$\gamma \in \left[\frac{\hat{\sigma}_W^2}{\rho}, \rho\hat{\sigma}_W^2\right],$$

the optimal threshold is $\hat{\gamma} = \rho\hat{\sigma}_W^2$.

(2) If $$P_A\eta + \frac{\hat{\sigma}_W^2}{\rho} < \phi \leq \rho\hat{\sigma}_W^2,\ \text{(i) } \frac{\partial P_E}{\partial \gamma} < 0$$

when $$\frac{\hat{\sigma}_W^2}{\rho} \leq \gamma < P_A\eta + \frac{\hat{\sigma}_W^2}{\rho},\ \text{(ii) } \frac{\partial P_E}{\partial \gamma} \geq 0$$

when $$P_A\eta + \frac{\hat{\sigma}_W^2}{\rho} \leq \gamma < \phi,$$

and $$\text{(iii) } \frac{\partial P_E}{\partial \gamma} < 0$$

when $\phi \leq \gamma \leq \rho\hat{\sigma}_W^2$. Hence, the optimal threshold is $\hat{\gamma} = \arg\min_{x \in \{P_A\eta + \hat{\sigma}_W^2/\rho, \rho\hat{\sigma}_W^2\}} P_E(x, \eta)$.

(3) If $$\phi > \rho\hat{\sigma}_W^2,\ \text{(i) } \frac{\partial p_E}{\partial \gamma} < 0$$

when $$\frac{\hat{\sigma}_W^2}{\rho} \leq \gamma < P_A\eta + \frac{\hat{\sigma}_W^2}{\rho},$$

and $$\text{(ii) } \frac{\partial P_E}{\partial \gamma} \geq 0$$

when $$P_A\eta + \frac{\hat{\sigma}_W^z}{\rho} \leq \gamma \leq \rho\hat{\sigma}_W^2.$$

Therefore, the optimal threshold is $$\hat{\gamma} = P_A\eta + \frac{\hat{\sigma}_W^2}{\rho}.$$

Case 2-2: $\lambda < 0.5$ and $$P_A\eta + \frac{\hat{\sigma}_W^2}{\rho} > \rho\hat{\sigma}_W^2$$

As $$\frac{\partial P_E}{\partial \gamma}$$

is always negative, the optimal threshold is $\hat{\gamma} = \rho\hat{\sigma}_W^2$.

Thus, there are essentially five cases for $\gamma$.

We have observed for eq. (7), as both $\Xi_1(x)$ and $\Xi_2(x)$ in $\overline{P}_E$ degrade when P gets larger, $\overline{P}_E$ is a decreasing function of P. Thus, for given $\lambda$ and $\Theta$, to maximize $\overline{R}_C$, the optimal $P(\lambda)$ should satisfy the covertness constraint with equality, i.e., $\overline{P}_E = \epsilon$. Also, as $\overline{P}_E$ monotonically decays with P, such transmit power $\hat{P}(\lambda)$ can be identified by using one-dimensional line search algorithms such as the bisection method. Then, the optimal transmit power is given by:

$$P(\lambda)=\min(\hat{P}(\lambda), P_{max}). \tag{11}$$

Due to the logarithm function in $\overline{R}_C$, it is intractable to derive an analytical closed-form expression for $\overline{R}_C$. Therefore, the transmission probability $\lambda$ is optimized with the aim of maximizing an upper bound of $\overline{R}_C$ which is given by:

$$\overline{R}_C \le \lambda\left[\log_2\left(1+\frac{P(\lambda)\mathbb{E}\left[\left|h_C+g_C^T\Theta h_I\right|^2\right]}{\sigma_C^2}\right)\right], \tag{12}$$

where the inequality follows from Jensen's inequality, and $$\mathbb{E}\left[\left|h_C+g_C^T\Theta h_I\right|^2\right] = \left(\frac{\pi^2}{16}N^2+\left(1-\frac{\pi^2}{16}\right)N\right)\chi_{h_I}\chi_{g_C}+\frac{\pi}{4}N\sqrt{\pi\chi_{h_I}\chi_{g_C}\chi_{h_C}}+\chi_{h_C}. \tag{13}$$

The upper bound of $\overline{R}_C$ is a unimodal function of $\lambda$ when the covertness constraint is taken into account. Therefore, the upper bound maximizing $\lambda$ can be obtained exploiting one-dimensional line search techniques such as the golden section search method.

Having presented the various equations above, we present a novel methodology to optimize the transmission probability, transmit power at the agent and the reflection matrix of the IRS with the goal of maximizing the achievable rate at a client while ensuring a covertness constraint.

Figure 4:
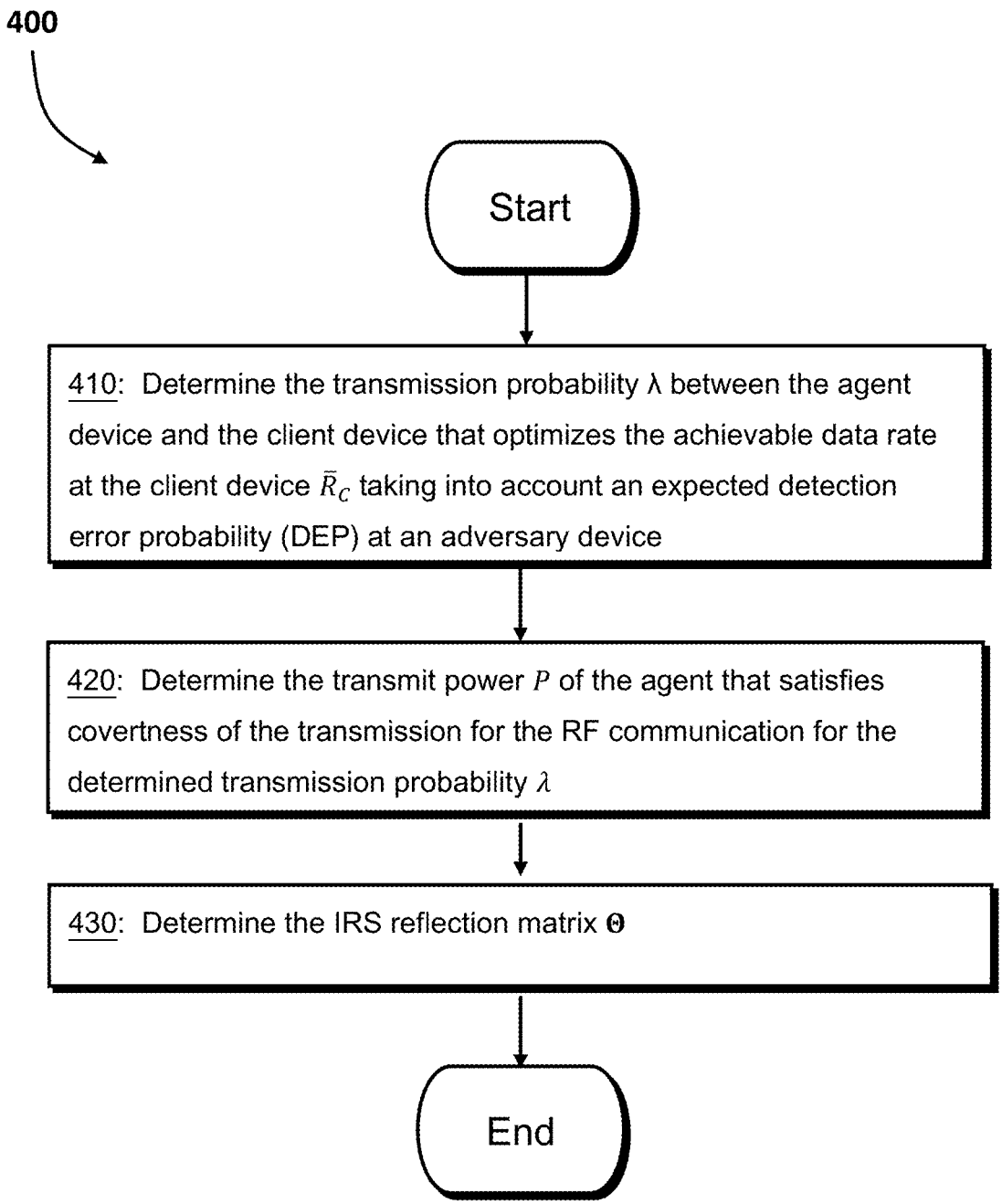
FIG. 4 depicts a flow chart of the novel methodology according to one embodiment of the invention.

FIG. 4 depicts a flow chart of the novel methodology 400 according to one embodiment of the invention. It allows us to establish a covert communication link between the agent device 102 and the client device 104 using the IRS 106. This includes configuring the IRS 106 for RF communication between the agent device 102 and the client device 104 for covert communications.

We can use method 400 for wireless network embodiments where a transmitter (e.g., agent, cellular base station, user equipment) sends a data to its receiver with the aid of an IRS to increase the coverage region and maximize the achievable rate at the client. In specific embodiments, it is suitable for any IRS-assisted networks where there exist security threats, low computational complexity is desirable, and only the statistic of the channel to a potential adversary is available. The method 400 establishes a secure covert wireless communication link between an agent and a client. It adaptively reconfigures the wireless network environments via controlled reflections. Again, our method presumes transmissions from the agent device 102 to the client device 104 and IRS 106. But the roles of the agent and the client can repeatedly change again and again as needed.

Method 400 establishes a covert communication link between the agent device 102 and the client device 104 using the IRS 106. This includes configuring the IRS 106 for RF communication between the agent device 102 and the client device 104 for covert communications. More particular, it determines a transmission probability $\lambda$ between the agent device and the client device, a transmit power P at an agent and a configuration of IRS elements $\Theta$ to optimize an achievable data rate at a client $\overline{R}_C$ while ensuring covertness of the transmission. Both $P_E$ and $\overline{P}_E$ are functions of P and $\lambda$, and so it is important to identify P and $\lambda$ to ensure the covertness of the communication.

We have found that when $\lambda$ is given, $\overline{P}_E$ is a decreasing function of P. The optimal power P is given by eq. (11). There, $\hat{P}$ is the value that satisfies the covertness condition $\overline{P}_E=\epsilon$. We have proved that $\overline{P}_E$ is a unimodal function (i.e., there exists a unique maximum) of $\lambda$. (Note: our proof is given in the related published paper).

Figure 6:
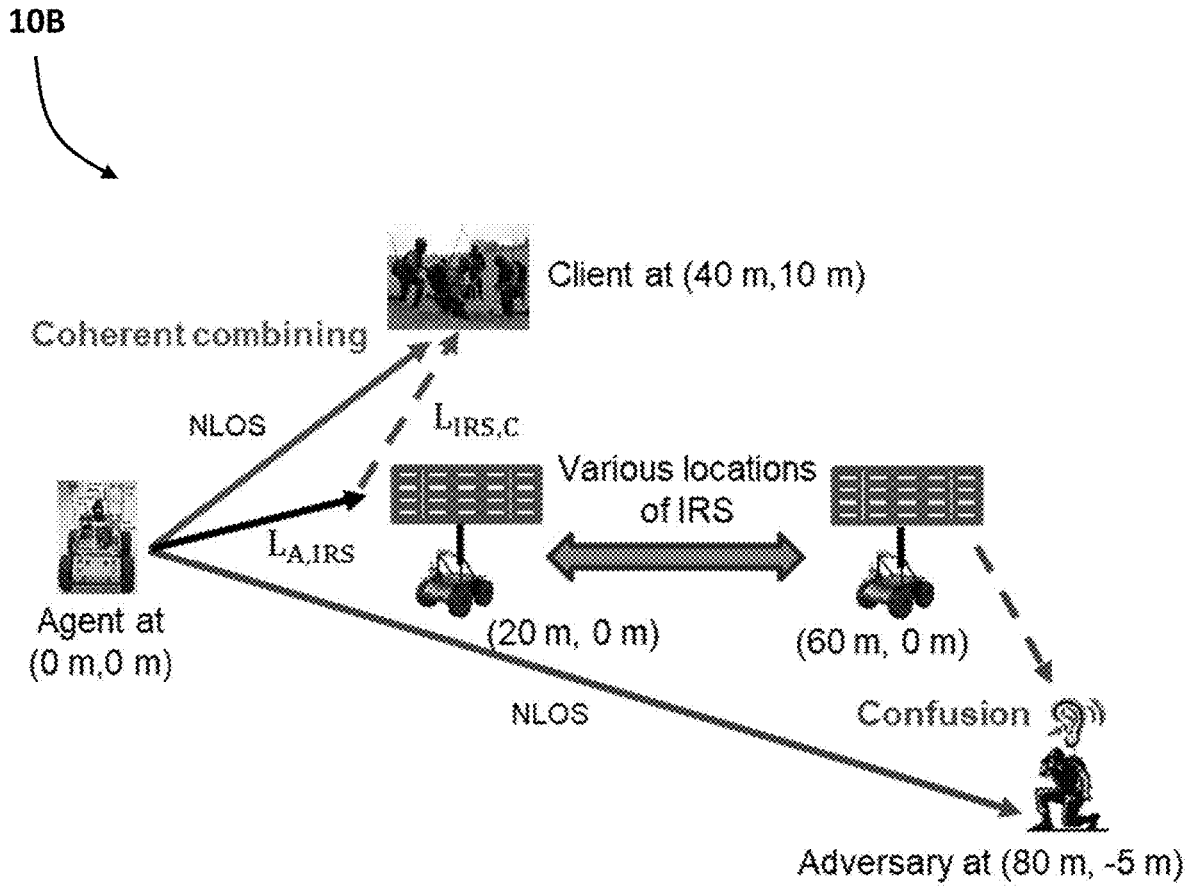
FIG. 6 is a schematic illustration of another network scenario.
Figure 7A:
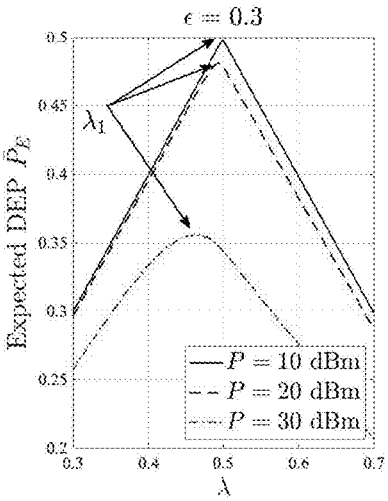
FIGS. 7A-7C are plots of the expected detection error probability, transmit power, and the upper bound of the covert data rate as a function of the transmission probability, respectively, based on the network scenario in FIG. 6.
Figure 7B:
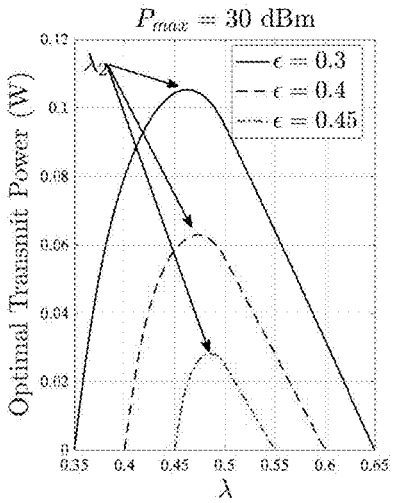
Figure 7C:
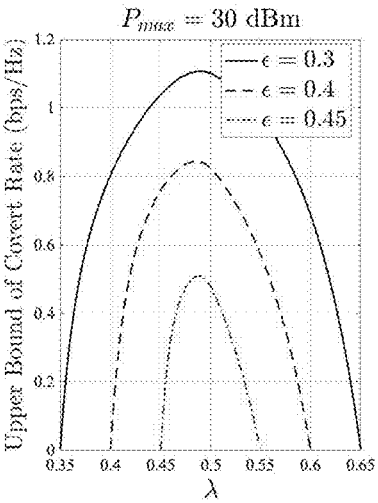

For ease of understanding we describe the steps of the method 400 with respect to FIGS. 7A-7C. These figures are plots of $\overline{P}_E$, P and the upper bound of the covert data rate $\overline{R}_C$ as function of $\lambda$, respectively. Specifically, we considered the network scenario in FIG. 6 when the horizontal distance between the agent and the adversary is 80 m as a non-limiting example of executing the method 400.

In step 410, we determine the transmission probability $\lambda$ between the agent device and the client device that optimizes an achievable data rate at the client device $\overline{R}_C$ taking into account an expected detection error probability (DEP) at an adversary device. This is a multiple step process.

First, we determine the estimated DEP. In FIG. 7A, we plotted the expected DEP at the adversary $\overline{P}_E$ as a function of transmission probability from the agent to the client $\lambda$. Here, we use eq. (7). $\overline{P}_E$ is determined by both $\lambda$ and P. A should be in $[\epsilon, 1-\epsilon]$ We assume a target DEP $\epsilon\ge0.2$ to ensure communication which cannot be identified and understood by the adversary. The plot shown is for the case with $\epsilon=0.3$. It shows three curves with different values of the transmit power P, i.e., 10, 20 and 30 dBm, respectively. Since $\overline{P}_E$ is a function of P, $\overline{P}_E$ changes when P changes. Therefore, the maximum $\overline{P}_E$ achieving $\lambda$ also changes when P changes. We define such maximum $\overline{P}_E$ achieving $\lambda$ by $\lambda_1$. We can use any technique for finding an extremum of a function, for example, to determine $\lambda_1$. One such technique that can be used is the golden section search, as we used. We identified $\lambda_1$ for the three curves in the plot.

Turning to FIG. 7B, we plotted the transmit power P as a function of $\lambda$. We used eq. (11) here. The maximum transmit power $P_{max}$ for the particular transmitter is 30 dBm, so this defines the upper bound. In the plot, we include three curves for different target DEP values $\epsilon$, i.e., 0.3, 0.4 and 0.45. From the plot in FIG. 7A, we can infer that $\overline{P}_E$ is an increasing function $\lambda\in[0, \lambda_1]$. Since $\overline{P}_E$ is a decreasing function of P, the optimal P is an increasing function of $\lambda\in[0, \lambda_1]$. $\overline{P}_E$ is a decreasing function $\lambda\in[\lambda_1, 1]$. Since $\overline{P}_E$ is a decreasing function of P, the optimal P is a decreasing function of $\lambda\in[\lambda_1, 1]$. In conclusion, the optimal P is also unimodal function of $\lambda$ (i.e., there is a unique maximum). This plot validates the fact that the optimal P is a unimodal function of $\lambda$ with various values of $\epsilon$. We define the optimal P achieving $\lambda$ by $\lambda_2$. We can use any technique for finding an extremum of a function, such as the golden section search method for example, to determine $\lambda_2$ too. We identified $\lambda_2$ for the three curves in the plot. To ultimately find the transmit power P in eq. (11), we can use any root-finding method, such as, for example, the bisection method, as we used.

Extremum finding techniques (such as the golden section search method) and root-finding methods (such as the bisection method) are well-known techniques for analyzing functions. (For more information, see E. K. P. Chong and S. H. Zak, *Introduction to Optimization*, 4th ed. Hoboken, N.Y., USA: Wiley, 2013).

We next determine the achievable data rate at the client device $\overline{R}_C$. We use eq. (12) here. This calculation is based on the transmit power P of the agent and transmission probability $\lambda$. In FIG. 7C, we plotted upper-bound of the covert data rate $\overline{R}_C$ as a function of $\lambda$ by using eq. (12) for different target DEP values $\epsilon$, i.e., 0.3, 0.4 and 0.45. The first term $\lambda$ in eq. (12) always increases as $\lambda$ gets higher, yet the power term in the logarithm portion of the eq. (12) increases as $\lambda$ gets higher only when $\lambda \in [0, \lambda_2]$. Therefore, we should increase $\lambda$ as much as possible when $\lambda \in [0, \lambda_2]$. However, the power term in log decreases as $\lambda$ gets higher when $\lambda \in [\lambda_2, 1]$. Thus, there should be a point having the maximum of the upper-bound in eq. (12) between $\lambda_2$ and 1. This fact is validated from the plot here. The maximums for the three curves in the plots occur at $\lambda$ values near, but not equal to, 0.5 as conventional techniques for IRS-assisted covert communication assume. Thus, we use these particular values for $\lambda$. To run the method, we do not need to find $\lambda_1$ and $\lambda_2$. We merely used them to show that the curves in FIG. 7C are unimodal functions. We can directly find the maximum of the curve in FIG. 7C by applying an extremum finding techniques for a function (such as the golden section search method) based on eq. (12).

Next, in step 420, we determine a transmit power P of the agent that satisfies a covertness constraint for the RF communication for the determined transmission probability $\lambda$ obtaining in step 410. Again, we used eq. (11) here. This time we get actual values for the transmit power P.

Lastly, in step 430, we determine the IRS reflection matrix $\Theta$. This provides configuration data for the reflecting elements of the IRS 106. We use eq. (10). Once again, the expected DEP in eq. (7) is irrelevant and independent of $\Theta$.

Method 400 may be embodied as software, hardware or some combination thereof. To that ends, computer-executable instructions (code) for implementation may be provided for. One skilled in the art can create suitable instructions (code) for executing the above-mentioned processing and mathematical calculations. In some embodiments, method 400 may be executed by the agent device 102 in cooperation with the IRS 106.

FIG. 5 depicts a simplified high-level block diagram of an exemplary transceiver 500 for an agent device (102 in FIG. 1) in accordance with an embodiment. The transceiver allows the device to both transmit and receive RF signals. In some embodiments, the client device (104 in FIG. 1) may also include this form of transceiver. The transceiver 500 comprises an antenna 502, an RF transmitter 504, an RF receiver 506, a controller 508 and, optionally, one or more sensors 510. In one embodiment, the transceiver 500 may be specifically configured to execute covert communications software 526 comprising computer-executable instructions or code to perform the method 400 (FIG. 4) as described above.

In one embodiment, the transmitter 504 is a conventional RF transmitter that is controlled by the controller 508 such that the transmitter shall transmit a data carrying communication signal. The transmitter 504 is capable of having the phase of the transmitted signal adjusted by the controller 508. The receiver 506 may be a conventional RF receiver that is controlled by the controller 508. When operating as a client, the receiver 506 receives communications signals from the agent. When the transceiver 500 is a portion of a client, the receiver 506 receives the signals from the agent.

The optional sensors 510 may include one or more of cameras, microphones, multispectral imaging (UV/visible/IR) sensors; antennas (RF; radio); ranging (radar; LIDAR) sensors; location/position sensors (GPS, altitude/depth, etc.), motion sensors (speed/velocity, bearing/trajectory, acceleration, etc.); weather sensors (temperature, pressure, wind speed, ambient lighting, etc.); field sensors (electric, magnetic, vibrations, radiation, biological, etc.) and the like. The signals to/from these sensors 510 are processed by the controller 508 and may be used locally or transmitted to the client from an agent or to an agent from a client.

In one embodiment, the controller 508 comprises at least one processor 512, memory 524 and various support subsystems and circuits such as, but not limited to, an RF input/output (I/O) interface 514, a clock 518, a phase control adjustor 520, a sensor(s) I/O interface 522, and a communications module 530. The RF input/output (I/O) interface 514 communicates with the RF hardware (e.g., receiver 506 and transmitter 504) so as to control the transmission/receptions of radio signals for Wireless communications. It includes frequency synchronization configured to carry out the novel concert communications methodology including handling the transmission in a manner to support the processing discussed above. The sensor(s) I/O interface 522 communicates with any sensor(s) which the agent or client may be equipped. The clock 518 is used for timing and establishing time slots. In one embodiment, the clock of each agent may be calibrated ahead of time such. The clock may also be synchronized to an external source such a satellite navigation system (e.g., a Global Positioning System (GPS)). In other embodiments, the agent could interface with the client (or another entity) for clock calibration. The communications module 530 generate signals for communications, including a RF communications signal generator 532 as generally known in the art. The module 530 may be capable of handling analog or digital signals, the later including packetized data. If desired, the signal generator 532 may provide encryption for provided confidential signals as known in the art.

In one embodiment, the controller 508 includes a processor 512 coupled to a memory 524. The processor 512 may be one or more of, or combinations thereof, microprocessors, microcontrollers, application specific integrated circuits (ASICs), and/or the like. The memory 524 may be any form of read only memory, random access memory or combinations thereof. In an embodiment, the memory 524 is a non-transitory computer readable media that stores secure communications software 526 and data 536 such that the processor 512 may execute the software 526 to implement the method 400 of FIG. 4 to perform covert communications in accordance with embodiments of the invention described above. Portions of the method 400 are appropriately performed by a controller 508 in the agent as described above. The data 536 may include communications data, control data and feedback data.

We provide some numerical simulation results to demonstrate the effectiveness of the novel methodology for the exemplary scenario 10B depicted in FIG. 6. More specifically, in this scenario, the positions of the agent and the client are fixed, and positions of the IRS and the adversary changing. Here, they are located at (0, 0), (40, 10), ($d_w$, −5), and ($d_I$, 0) in meter (m), respectively. Here, $d_w$ is the horizontal distance between the agent and adversary and $d_I$ is the horizontal distance between the agent and the IRS. We show the adversary located at (80, −5) and the IRS, first at (20, 0) and then at (60, 0). However, we consider various values for distances.

Figure 8:
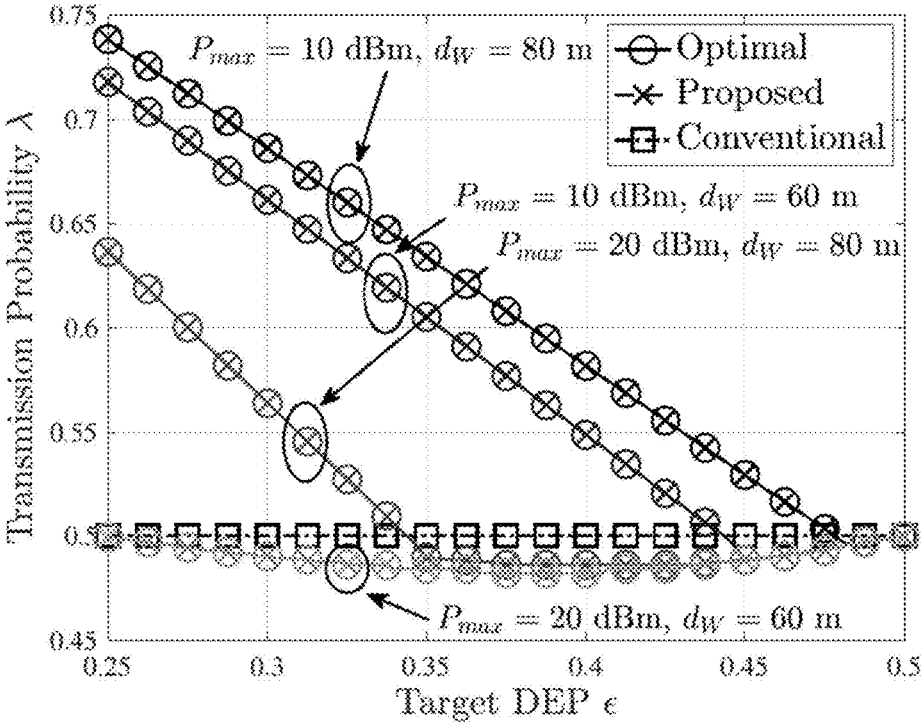
FIGS. 8-10 are plots showing the simulated data for our novel methodology and a conventional methodology for the network scenario in FIG. 6.
Figure 9:
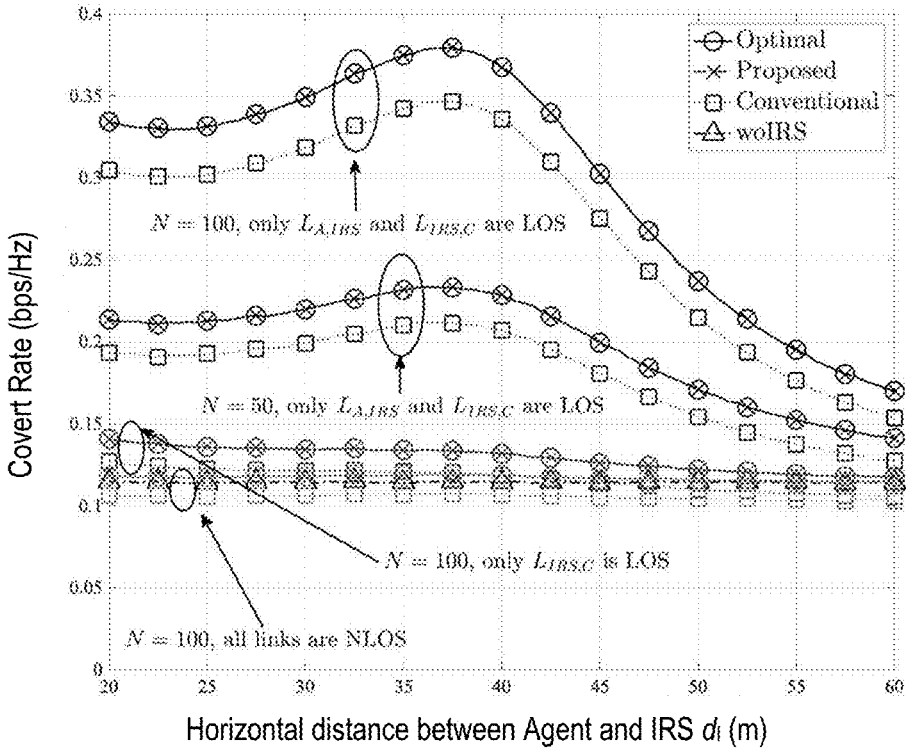
Figure 10:
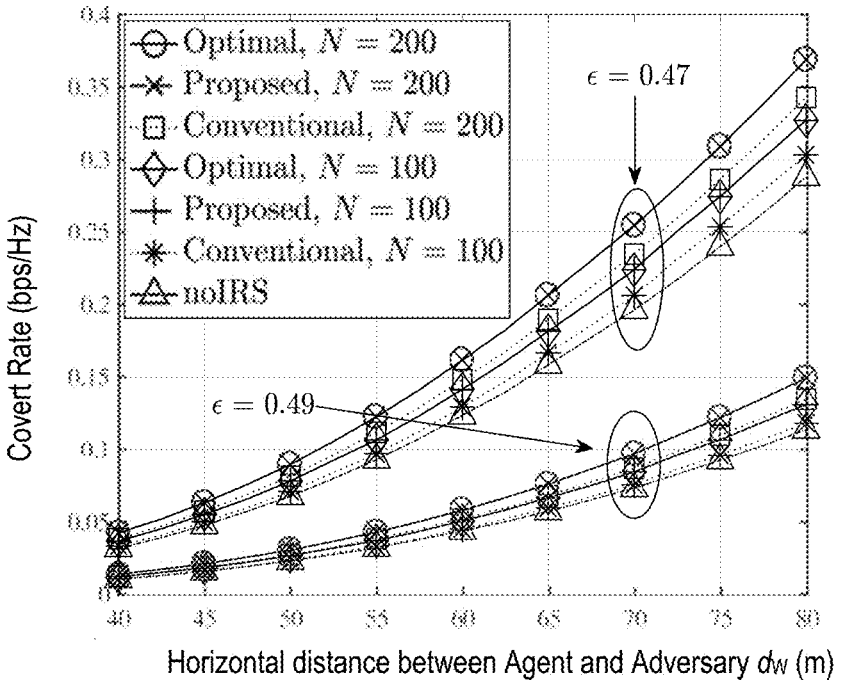

FIGS. 8-10 are plots showing the simulated data for our novel methodology and a conventional methodology. For the conventional method data shown in those three plots, we used the technique introduced in J. Si et al., "Covert transmission assisted by intelligent reflecting surface," January 2021, herein incorporated by reference in its entirety. That paper optimizes only P and $\Theta$ assuming that $\lambda$ is fixed to 0.5.

More particularly, FIG. 8 is a plot of the transmission probability $\lambda$ as a function of the target DEP; FIG. 9 is a plot of the covert data rate $\overline{R}_C$ as a function of the distance between the agent and the IRS $d_I$; and FIG. 10 is a plot of the covert data rate $\overline{R}_C$ as a function of the horizontal distance between the agent and the adversary $d_w$.

For the distance between a transmitter and a receiver d, the channel gain is modeled by $\chi(d)$ (in dB)$=G_t+G_r-37.5-22\log_{10}(d)$ if line-of-sight (LOS) and $\chi(d)$ (in dB)$=G_t+G_r-35.1-36.7\log_{10}(d)$ if non-LOS (NLOS) where $G_t$ and $G_r$ are the transmitter and receiver antenna gains, respectively, following the technique discussed in E. Björnson et al. (2020), discussed above. Also, we denote $L_{i,j}$ as the link between nodes i and j where nodes A, C, IRS, and W indicate the agent, the client, the IRS, and the adversary, respectively. Unless otherwise stated, we set $P_{max}=20$ dBm, $\sigma_C=\hat{\sigma}_W^2=-80$ dBm, $\rho=3$ dB and $G_t=G_r=0$ dBi.

In FIG. 8, we evaluate the transmission probability $\lambda$ of the proposed strategy with various values of $\epsilon$, $P_{max}$, and $d_w$ when $d_I=40$ m, N=100, and all links are NLOS. Here, the optimal scheme means the case where the upper bound of $\overline{R}_C$ in Eq. (12)) maximizing $\lambda$ is found by the exhaustive search approach. First, it is observed that the proposed algorithm yields only negligible performance loss compared to the optimal one. As expected, $\lambda$ converges to 0.5 if $\epsilon\rightarrow 0.5$ since the maximum achievable $\overline{P}_E$ is $\min(\lambda, 1-\lambda)$. Also, we can see that when the available power $P_{max}$ decays, $\lambda$ increases to enhance $\overline{R}_C$ . If the adversary is close to the agent, to conceal the presence of transmission, P becomes smaller, and therefore $\lambda$ gets lower due to the fact that $\overline{P}_E$ is a decreasing function of P and $\overline{P}_E$ is a unimodal function of $\lambda$. The covert data rate $\overline{R}_C$ of the novel methodology is compared with the optimal performance in FIGS. 9 and 10. Here, the optimal performance is obtained by exhaustively comparing all possible combinations of P and $\lambda$ with $\Theta$ in Eq. (10) and choosing P and $\lambda$ that maximize the exact rate $\overline{R}_C$ in Eq. (8)). In addition, the no IRS shows the performance of the case where P and $\lambda$ are optimized when there is no IRS.

FIG. 9 examines the covert rate $\overline{R}_C$ when $\epsilon=0.49$ and $d_w=80$ m. It is seen there that the proposed strategy exhibits almost identical performance with the optimal performance, and $\overline{R}_C$ increases as N grows. In addition, $\overline{R}_C$ is significantly improved when $L_{A,IRS}$ and $L_{IRS,C}$ are LOS, and the influence of the location of the IRS is more pronounced when $L_{A,IRS}$ and $L_{IRS,C}$ are LOS. By comparing the novel methodology with the no IRS and conventional schemes, we can observe that the $\overline{R}_C$ can be enhanced by utilizing an IRS or optimizing $\lambda$.

In FIG. 10, we illustrate the covert rate $\overline{R}_C$ when $d_I=40$ m and only the link $L_{IRS,C}$ is LOS. As expected, $\overline{R}_C$ decays as the target DEP $\epsilon$ becomes higher or N decreases. It is also shown that $\overline{R}_C$ is an increasing function of $d_w$ since P grows as $d_w$ gets larger. Lastly, we can confirm that the novel methodology experiences a better performance than the no IRS and conventional approaches, and achieves near optimal performance.

These plots clearly show that the conventional IRS-aided technique does not consider the optimization of the transmission probability for the enhancement of the covertness of the communication. By contrast, by applying our methodology 400 we form covert wireless networks that satisfy the covertness constraint while maximizing the achievable rate at the client with low computational complexity. Our methodology provides near optimal performance and has low computational complexity since it may utilize only one-dimensional line search methods. From numerical simulations, we have verified that, by applying our novel methodology, the achievable data rate can be enhanced by 200% compared to the conventional method without an IRS and by 11% compared to the conventional scheme without the transmission probability optimization.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, and to describe the actual partial implementation in the laboratory of the system which was assembled using a combination of existing equipment and equipment that could be readily obtained by the inventors, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

We claim:

1. A method for covert wireless RF communications between an agent device and a client device in the presence of an adversary device which attempts to detect the existence of the transmission of the RF communication between the agent and client, the method comprising:

providing an intelligent reflecting surface (IRS) to reflect wireless radio frequency (RF) communication signals transmitted from the agent device to the client device, the IRS comprising a two-dimensional array of individually controllable RF reflecting elements; and establishing a covert RF communication link between the agent device and the client device by:

determining a transmission probability $\lambda$ between the agent device and the client device, a transmit power P at an agent and an IRS reflection matrix $\Theta$ for configuration data for the IRS elements to optimize an achievable data rate at a client $\overline{R}_C$while ensuring covertness of the transmission.

2. The method of claim 1, wherein ensuring covertness of the transmission means an expected DEP is larger than a target DEP $\epsilon$.

3. The method of claim 1, wherein establishing the covert communication link between the agent device and the client device by said determining comprises:

a. determining the transmission probability $\lambda$ between the agent device and the client device that optimizes the achievable data rate at the client device $\overline{R}_C$ taking into account an expected detection error probability (DEP) at an adversary device;

b. determining the transmit power P of the agent that satisfies covertness of the transmission for the RF communication for the determined transmission probability $\lambda$; and c. determining the IRS reflection matrix $\Theta$.

4. The method of claim 3, wherein the determination in step a seeks to maximize an upper bound of the achievable data rate at the client device $\overline{R}_C$.

5. The method of claim 3, wherein the DEP is computed using a statistic of the channel to the adversary device.

6. The method of claim 5, wherein the DEP is computed according to the following equation:

$$P_E = \frac{1}{2\ln(\rho)x}\left[\lambda\ln\left(\frac{\max(\gamma - P\eta, \hat{\sigma}_A^2/\rho)}{\hat{\sigma}_A^2/\rho}\right) + (1-\lambda)\ln\left(\frac{\rho\hat{\sigma}_A^2}{\gamma}\right)\right],$$

where $\rho$ is the degree of the noise uncertainty at the adversary device; P is the transmit power of the agent device; $\eta \triangleq |h_A + g_A^T \Theta h_I|^2$; $\hat{\sigma}_A^2$ is the nominal noise power of the adversary device; $\gamma$ is a detection threshold at the adversary; and $\lambda$ is the transmission probability between the agent and the client.

7. The method of claim 3, wherein the covertness constraint is $\overline{P}_E = \epsilon$ for $\epsilon \in [0, \min(\lambda, 1-\lambda))$ and is computed from the expected DEP according to the following equation:

$$\overline{P}_E = \frac{\tau}{2\ln(\rho)}\int_0^{\frac{\hat{\sigma}_A^2(\rho-1/\rho)}{P}} \min(\lambda\Xi_2(x),\ (1-\lambda)\Xi_1(x))e^{-\tau x}dx,$$

where $$\tau = \chi_{h_A} + N\chi_{h_I}\chi_{g_A},$$

$$\Xi_1(x) = \ln\left(\frac{\rho\hat{\sigma}_A^2}{Px + \hat{\sigma}_A^2/\rho}\right)$$

and $$\Xi_2(x) = \ln\left(\frac{\rho\hat{\sigma}_A^2 - Px}{\hat{\sigma}_A^2/\rho}\right)$$

and N is the number of IRS elements, and $\chi_{h_A}$, $\chi_{h_I}$ and $\chi_{g_A}$ are large-scale path losses of the corresponding channels.

8. The method of claim 3, wherein the achievable data rate at the client device $\overline{R}_C$ is computed according to the following equation:

$$\overline{R}_C = \lambda\mathbb{E}\left[\log_2\left(1 + \frac{P|h_C + g_C^T\Theta h_I|^2}{\sigma_C^2}\right)\right],$$

where P is the transmit power of the agent device; $\lambda$ is the transmission probability between the agent and the client; $\sigma_C^2$ is the variance of the noise at the client.

9. The method of claim 3, wherein the determination in step c the IRS reflection matrix $\Theta = \mathrm{diag}\{e^{j\theta_1}, e^{j\theta_2}, \ldots, e^{j\theta_N}\}$ and is computed according to the following equation:

$$\theta_n = \arg(h_C) - \arg(g_{C,n}) - \arg(h_{I,n}),\ \forall n,$$

where $\arg(\alpha)$ is the angle of complex scalar $\alpha$, and $g_{C,n}$ and $h_{I,n}$ indicate the n-th elements of $g_C$ and $h_I$ of the IRS, respectively.

10. The method of claim 3, wherein the IRS reflection matrix $\Theta$ is computed in every communication slot.

11. The method of claim 3, wherein the determination in step a is performed using an extremum-finding algorithm.

12. The method of claim 11, wherein the extremum-finding algorithm is a golden section search scheme.

13. The method of claim 3, wherein the determination in step b is performed using a root-finding algorithm.

14. The method of claim 13, wherein the root-finding algorithm is a bisection method.

15. The method of claim 3, further comprising: wirelessly transmitting the determined IRS reflection matrix $\Theta$ from the agent device to the IRS.

16. The method of 3, further comprising: configuring the IRS for RF communication between the agent device and the client device based on the determined IRS reflection matrix $\Theta$.

17. A wireless network comprising:

an intelligent reflecting surface (IRS) comprising a 2D array individually-controllable RF reflecting elements to reflect a wireless radio frequency (RF) signals transmitted from an agent device to an client device; and a controller configured to establish a covert RF communication link between the agent device and the client device by:

determining a transmission probability $\lambda$ between the agent device and the client device, a transmit power P at an agent and an IRS reflection matrix $\Theta$ for configuration data for the IRS elements to optimize an achievable data rate at a client $\overline{R}_C$ while ensuring covertness of the transmission.

18. The wireless network of claim 17, wherein, in establishing the covert communication link between the agent device and the client device by said determining, the controller:

a. determines the transmission probability $\lambda$ between the agent device and the client device that optimizes the achievable data rate at the client device $\overline{R}_C$ taking into account an expected detection error probability (DEP) at an adversary device;

b. determines the transmit power P of the agent that satisfies covertness of the transmission for the RF communication for the determined transmission probability $\lambda$; and c. determines the IRS reflection matrix $\Theta$.

19. The wireless network of claim 17, wherein there IRS comprises at least 20 RF reflecting elements.

20. The wireless network of claim 17, wherein each of the individually controllable RF reflecting elements is configured to provide a phase shift to the reflected signal.

* * * * *